US011975371B2

(12) United States Patent
Kellermayr

(10) Patent No.: US 11,975,371 B2
(45) Date of Patent: May 7, 2024

(54) COLD ROLLING OF ROLLED STOCK

(71) Applicant: Primetals Technologies Austria GmbH, Linz (AT)

(72) Inventor: Roland Kellermayr, St. Marien (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 52 days.

(21) Appl. No.: 17/626,949

(22) PCT Filed: Jul. 14, 2020

(86) PCT No.: PCT/EP2020/069895
§ 371 (c)(1),
(2) Date: Jan. 13, 2022

(87) PCT Pub. No.: WO2021/009174
PCT Pub. Date: Jan. 21, 2021

(65) Prior Publication Data

US 2022/0258220 A1 Aug. 18, 2022

(30) Foreign Application Priority Data

Jul. 17, 2019 (EP) ..... 19186746

(51) Int. Cl.
*B21B 27/02* (2006.01)
*B21B 13/02* (2006.01)
(Continued)

(52) U.S. Cl.
CPC ..... *B21B 27/021* (2013.01); *B21B 13/02* (2013.01); *B21B 31/02* (2013.01); *B21B 31/07* (2013.01);
(Continued)

(58) Field of Classification Search
CPC ..... B21B 27/021; B21B 13/02; B21B 31/02; B21B 31/07; B21B 31/08; B21B 31/10;
(Continued)

(56) References Cited

U.S. PATENT DOCUMENTS 3,747,387 A * 7/1973 Shumaker ..... B21B 31/10 72/239
4,238,947 A * 12/1980 Graham ..... B21B 31/02 72/237
(Continued)

FOREIGN PATENT DOCUMENTS

CN 104114295 A 10/2014
CN 104438318 A 3/2015
(Continued)

OTHER PUBLICATIONS

International Search Report dated Oct. 6, 2020 in corresponding PCT International Application No. PCT/EP2020/069895.
(Continued)

*Primary Examiner* — Matthew Katcoff
*Assistant Examiner* — Mohammed S. Alawadi
(74) *Attorney, Agent, or Firm* — OSTROLENK FABER LLP

(57) ABSTRACT

A rolling device (1), a method and a rolling train (35) for the cold rolling of rolled stock (3). The rolling device (1)-a rolling stand (5), multiple assembly sets for optionally assembling the rolling stand (5) with one of the assembly sets, and a working-roll drive. Each assembly set comprises two working rolls (7, 8), and for each working roll (7, 8) two working-roll chocks (9). A spindle head (11), can be connected to a working roll journal (16) of the working roll (7, 8). The working rolls (7, 8) of different assembly sets have different working-roll diameter ranges, which are determined by a respective minimum working-roll diameter and
(Continued)

maximum working-roll diameter. The rolling stand (5) has mountings (19) for a respective working-roll chock (9) of an assembly set. The working-roll drive has two drive spindles (27), each for driving a working roll (7, 8) via the spindle head (11) assigned to the working roll (7, 8) by rotations about a longitudinal axis of the drive spindle (27).

16 Claims, 3 Drawing Sheets

(51) Int. Cl.

| | |
|---|---|
| ***B21B 31/02*** | (2006.01) |
| ***B21B 31/07*** | (2006.01) |
| ***B21B 31/10*** | (2006.01) |
| ***B21B 35/00*** | (2006.01) |
| ***B21B 35/14*** | (2006.01) |

(52) U.S. Cl.
CPC ..... *B21B 31/10* (2013.01); *B21B 35/141* (2013.01); *B21B 2203/28* (2013.01); *B21B 2267/06* (2013.01)

(58) Field of Classification Search
CPC ..... B21B 31/18; B21B 35/14; B21B 35/141; B21B 2203/28; B21B 2267/06; B21B 35/00; B21B 29/00; B21B 2027/022
See application file for complete search history.

(56) References Cited

U.S. PATENT DOCUMENTS

| | | | | |
|---|---|---|---|---|
| 5,927,127 | A | 7/1999 | Klamma et al. | 72/229 |
| 7,165,432 | B2 | 1/2007 | Berendes et al. | 72/239 |
| 7,302,820 | B2 | 12/2007 | Le Viavant | |
| 7,698,923 | B2 | 4/2010 | Rackel | 72/239 |
| 9,162,266 | B2 | 10/2015 | Keller et al. | 72/236 |
| 2016/0339492 | A1* | 11/2016 | Imanari | B21B 37/46 |

FOREIGN PATENT DOCUMENTS

| | | | |
|---|---|---|---|
| CN | 107900108 | A | 4/2018 |
| CN | 207981856 | U | 10/2018 |
| CN | 109647894 | A | 4/2019 |
| DE | 856 735 | C | 11/1952 |
| JP | S61-37306 | A | 2/1986 |
| RU | 2311242 | C2 | 11/2007 |
| RU | 2363555 | C2 | 8/2009 |
| TW | 200918195 | A | 5/2009 |

OTHER PUBLICATIONS

Written Opinion dated Oct. 6, 2020 in corresponding PCT International Application No. PCT/EP2020/069895.
European Search Report dated Jan. 7, 2020 in corresponding European Patent Application No. 19186746.4.
Chinese Office Action, dated Feb. 11, 2023, issued in corresponding Chinese Patent Application No. 202080051553.3, with English Search Report.
EPO Communication under Rule 71(3) EPC dated Mar. 13, 2023, issued in corresponding European Patent Application No. 20742679.2.

* cited by examiner

COLD ROLLING OF ROLLED STOCK

CROSS-REFERENCE TO RELATED APPLICATIONS

The present application is a 35 U.S.C. §§ 371 national phase conversion of PCT/EP2020/069895, filed Jul. 14, 2020, the contents of which are incorporated herein by reference, which claims priority of EP Patent Application No. 19186746.4 filed Jul. 17, 2019, the contents of which are incorporated by reference herein. The PCT International Application was published in the German language.

FIELD OF THE INVENTION

The invention relates to a rolling device, a method and a rolling train for the cold rolling of rolled stock.

During cold rolling, a rolled stock, for example a metallic rolled strip, is guided between two working rollers that are spaced apart by a rolling gap. The working rollers are arranged in a rolling stand and are rotated about their longitudinal axes by a drive. A plurality of rolling stands are often arranged one behind the other and form what is known as a rolling train, through which the rolled stock passes in a rolling direction, wherein the thickness of the rolled stock is reduced in steps. In typical applications, the rolling speed increases from rolling stand to rolling stand and the rolling torques decrease from rolling stand to rolling stand. The number of rolling stands and the maximum reduction in their thickness can, however, not be arbitrarily increased from a process technology perspective, since the material strength of the rolled stock increases as a function of the reduction in thickness. Above certain rolled-stock strength values and working roller diameters, this results in high degrees of flattening of the working rollers and a lessened reduction in thickness of the rolled stock.

In addition to the working rollers, a rolling stand usually has what are known as back-up rollers, which support the working rollers. Each roller is rotatably mounted at its ends on bearings, each of which is carried by what is known as a chock. The chock is installed to be vertically displaceable in a mount of the rolling stand. Vertical displacability of the chocks makes it possible to change the positions of the rollers and adapt them to one another and to the thickness of the rolled stock. Bending forces can further be exerted on the working rollers via the working roller chocks. The bending forces cause the working rollers to be slightly bent during the rolling in order to achieve a uniform thickness of the rolled stock in the axial direction, that is along the longitudinal axes of the working rollers.

The working rollers wear away as the rolled stock is rolled. Therefore, the working rollers each become ground down after a certain rolling time. This successively reduces the roller diameters of the working rollers. Finally, the working rollers are replaced when their grinding down has reduced their roller diameters to a minimum working roller diameter. The diameter of a working roller used for the first time is equal to the maximum working roller diameter of the working roller and can be reduced to the minimum working roller diameter by being repeatedly ground down. The difference between the maximum and minimum working roller diameters is determined inter alia by what is known as the hardening depth, which defines that region which extends from the surface of a working roller radially into the interior and has a greater hardness than the rest of the material of the working roller. Only when the current diameter of a working roller is between the corresponding maximum and minimum working roller diameter, and thus the current surface of the working roller in a region with greater hardness than the rest of the working roller body. Then the working roller is used on the rolling stand. The minimum and the maximum working roller diameter of a working roller thus defines the working roller diameter range of this working roller within which the working roller can be used expediently for rolling. If the working roller diameter were to leave the working roller diameter range as a result of being ground down further, it is no longer used.

The minimum working roller diameter is also determined by the rolling parameters (rolling torque, rolling force, rolling tension, rolling speed) and their effect on the selection of the working-roller bearings and working roller journals on which the working rollers are driven and which in turn determine a minimum internal diameter of the working-roller bearings. The external diameter and the width of a working-roller bearing determine the capacity of the working-roller bearing. A recommended minimum wall thickness of the working roller chock corresponds to the external diameter and the loading on the working-roller bearing. Therefore, the dimensions of the working-roller bearings, the wall thicknesses of the working roller chocks, and a safety distance, which should prevent the working rollers and working roller chocks from colliding, determine the minimum usable diameter of the working rollers. The rolling parameters are in turn determined by the material properties of the rolled stock and by its run-in thickness, run-out thickness and width.

Thus, a relatively soft rolled stock with a large width and thickness and a high required reduction in thickness of more than 80 percent, for example, places high torque demands specifically on the first two rolling stands of a rolling train and brings about high thermal loading on the components of the rear rolling stands. Large working-roller diameters are therefore preferred for such rolling of soft rolled stock.

The rolling of high-strength and ultra-high-strength rolled stock with run-out thicknesses of more than 0.5 mm, for example, results in high rolling forces on all rolling stands and specifically in a lower level of reduction in thickness on the rear rolling stands (for example on the third and the fourth rolling stand) compared to softer rolled stock. The torque demands are in the relatively high and ultra-high range. The rolling of very thin, high-strength rolled stock, for example for producing electrical steel strip with a relatively high silicon content and run-out thicknesses of less than 0.5 mm, produces high specific rolling forces with moderate torques. In both cases, medium and large working roller diameters result in high degrees of flattening of the working rollers on the rear rolling stands. Therefore in these cases, small working-roller diameters are preferred, in particular on the rear rolling stands.

The invention is based on the object of specifying a rolling device, a method and a rolling train which make it possible to produce different rolled products, in particular rolled products having different hardnesses and thicknesses.

A rolling device according to the invention for the cold rolling of rolled stock comprises a rolling stand, a plurality of equipment sets for the purpose of selectively equipping the rolling stand with one of the equipment sets, and a working roller drive. Each equipment set comprises two working rollers and, for each working roller, two working roller chocks assigned to that working roller. Each working roller has at least one working-roller bearing for the working roller, and a spindle head, assigned to the working roller, which can be connected in a form-fitting manner to a working roller journal of the working roller. Working rollers of the same equipment set each have the same working roller diameter range. The working rollers of different equipment sets have working roller diameter ranges which differ from one another. The working roller diameter range of one equipment set differs from the working roller diameter range of another equipment set when at least the minimum or the maximum working roller diameter of the working rollers of the one equipment set differs from the respective minimum or maximum working roller diameter of the working rollers of the other equipment set. The rolling stand has mounts, which are designed to respectively receive a working roller chock of one equipment set. The working roller drive has two drive spindles which are respectively designed to drive a working roller via the spindle head assigned to the working roller by rotations about a longitudinal axis of the drive spindle.

The rolling stand of a rolling device according to the invention can therefore be equipped with working rollers having different working roller diameter ranges. For this purpose, each equipment set comprises working roller chocks corresponding to its two working rollers, in order to install the working rollers in the rolling stand, and, for each working roller, a corresponding spindle head, via which the working roller can be driven by a drive spindle of the working roller drive. This means that the rolling stand can advantageously be adapted to the respective rolled stock. Thus, for example, it is possible to use working rollers having a smaller working roller diameter for rolling high-strength rolled stock than for rolling relatively soft rolled stock. The different installation height of equipment sets having working rollers with different working roller diameter ranges can be compensated for by the vertical displacability of the chocks in the rolling stand. As a result, a rolling device according to the invention is suitable for a wide range of rolled products to be produced. In particular, using the same rolling device, the invention aims to be able to profitably process both relatively soft rolled stock and to be able to produce high-quality, high-strength steel products having small thicknesses, for example thicknesses of less than 0.5 mm.

In one embodiment of the rolling device, the working-roller bearings of all equipment sets are in the form of roller bearings, for example tapered roller bearings.

In a further embodiment of the rolling device, the minimum working roller diameter differs from the maximum working roller diameter of one equipment set by 40 mm to 90 mm.

In a further embodiment of the rolling device, the working rollers of one equipment set have a minimum working roller diameter of 340 mm and a maximum working roller diameter of 385 mm, and the working rollers of another equipment set have a minimum working roller diameter of 375 mm and a maximum working roller diameter of 460 mm. As a result, a rolling stand can be configured for rolling ultra-high-strength rolled stock, for which roller diameters of less than 375 mm are required, only by changing the equipment set. This advantageously allows the range of products that can be produced to be expanded with low outlay.

The internal diameters of the working-roller bearings of all equipment sets preferably deviate from one another by at most two percent. This makes it possible to use working rollers having working roller journals with the same journal diameter, with the result that the spindle heads also have the same internal diameters and the working rollers of all equipment sets can be driven by the same drive spindles. The drive spindles therefore do not have to be changed when the rolling stand is retooled with working rollers having another working roller diameter. Accordingly, a further embodiment of the rolling device provides that the working roller journals of the working rollers of all equipment sets have identical journal diameters and journal shapes.

A diameter ratio of an external diameter to an internal diameter of a working-roller bearing may decrease as the working roller diameter range of the working rollers of the equipment sets decreases. For example, a diameter ratio of an external diameter to an internal diameter of the working-roller bearings of at least one equipment set is at most 1.41, and a diameter ratio of an external diameter to an internal diameter of the working-roller bearings of at least one other equipment set is at most 1.32. The rolling stand can be adapted to corresponding grades of rolled stock by selecting the equipment set with a respective diameter ratio of the working-roller bearings. Decreasing the diameter ratio of the working-roller bearings to the working roller diameter takes into account that the sum of the outer radius of the working-roller bearings and the wall thickness of the working roller chocks on the sides facing toward the rolled stock must be smaller than the minimum working roller radius. Otherwise, the working-roller bearings of the two oppositely situated working rollers in the rolling stand would collide or get in each other's way. A diameter ratio that is as low as possible, in particular given a predefined internal diameter of the working-roller bearings, allows a lowest possible installation height of the working roller chocks and thus small working-roller diameters. Small working-roller diameters are suitable in turn for rolling high-strength and ultra-high-strength rolled stock, in particular in rear rolling stands of a rolling train as has already been explained above. Small working-roller diameters also make it easier to bend the working rollers because the bending forces required for the bending are reduced.

In a further embodiment of the rolling device, a ratio of a height of a working roller chock to an external diameter of a working-roller bearing of at least one equipment set is less than 1.09. This embodiment of the rolling device is also aimed at reducing the working roller diameter by reducing the height of the working roller chocks. Given a predefined internal diameter of the working-roller bearings, the reduction in the height of a working roller chock is made possible, in particular in combination with the above-mentioned reduction in the diameter ratio of the external diameter to an internal diameter of the working-roller bearing.

In a further embodiment of the rolling device, a minimum wall thickness of a working roller chock of at least one equipment set, on that side of the working roller chock that faces toward the rolled stock, is less than six percent of an external diameter of a working-roller bearing of the working roller chock.

In a further embodiment of the rolling device, a minimum wall thickness of a working roller chock of at least one equipment set on a side facing toward the rolled stock is at most as great as a minimum wall thickness on a side of the working roller chock that faces away from the rolled stock.

The aforementioned embodiments of the rolling device take into account that the working roller chocks approach one another as the working roller diameters decrease, and thus the risk of the working roller chocks colliding or getting in each other's way increases. A reduction in the minimum wall thicknesses of the working roller chocks on their sides facing toward the rolled stock increases the distance between the working roller chocks and thus enables a further reduction in the working roller diameters without the working roller chocks colliding or getting in each other's way.

In the method according to the invention for the cold rolling of rolled stock by a rolling device, the rolling stand is equipped with an equipment set which is selected depending on the rolled stock. In this way, in particular, the working roller diameters of the working rollers used for the rolling are adapted to the strength, width, run-in thickness and/or run-out thickness of the rolled stock.

In one embodiment of the method according to the invention, the rolling stand is equipped with an equipment set which is selected depending on a position of the rolling device in a rolling train. The position of a rolling device in a (multi-stand) rolling train is understood to mean the position taken up by the rolling stand of the rolling device in a sequence of all rolling stands of the rolling train in which the rolled stock passes through the rolling stands. This embodiment of the method according to the invention takes into account that the strength and thickness of the rolled stock and also the rolling speed and the required rolling torques change along the rolling train, as a result of which in turn the working roller diameters of the working rollers of a rolling device that are most advantageous for the rolling process can depend on the position of the rolling device in the rolling train.

In a further embodiment of the method according to the invention, for at least one equipment set, a bending limit for positive bending of the working rollers is set as a function of a minimum wall thickness of the working roller chocks on the sides of the working roller chocks that face toward the rolled stock, and the working rollers are not positively bent above the bending limit. This embodiment of the method according to the invention is aimed in particular at the above-mentioned embodiment of a rolling device according to the invention, in which minimum wall thicknesses of working roller chocks on sides that face toward the rolled stock are reduced. A reduction in these wall thicknesses reduces the load-bearing capacity of the working roller chocks in the event of positive bending of the working rollers. The above-mentioned embodiment of the method according to the invention takes this into account by correspondingly limiting positive bending of the working rollers.

In a further embodiment of the method according to the invention, the working rollers of at least one equipment set are negatively bent depending on a crown of the working rollers. This embodiment of the method according to the invention is also aimed at relieving the working roller chocks of load when the working rollers bend on their sides that face toward the rolled stock, such that, instead of positive bending, which subjects these sides to high loading, negative bending of the working rollers that interacts with a crown of the working rollers is preferably carried out. This presupposes a suitably configured crown of the working rollers.

In a further embodiment of the method according to the invention, for at least one equipment set, an axial displacement of the working rollers relative to one another is set as a function of a width and thickness of the rolled stock. This makes it possible to relieve the strip edges of the rolled stock of load, for example to avoid cracks in the strip edges, which can arise when the strip edges are not relieved of load in the event of rolling rolled stock that is at risk of edge cracks, for example electrical steel strip with a silicon content of at least two percent. In addition, such a mutual axial displacement of the working rollers makes it possible to prevent center regions of the working rollers, in which the working rollers adopt their maximum working-roller diameter, from touching in the region outside the rolled stock when very thin rolled stock is being rolled.

A rolling train according to the invention has at least one rolling device according to the invention. The advantages of such a rolling train emerge from the above-mentioned advantages of a rolling device according to the invention. In particular, a rolling train according to the invention enables the rolling devices according to the invention to be retooled depending on the respective rolled stock, so that adaptation of the equipment of the rolling stands of these rolling devices to the rolled stock, thus makes it possible for the same rolling train to process different rolled stock or to produce different rolled products.

The above-described properties, features and advantages of this invention and the manner in which they are achieved will become clearer and more clearly understandable in connection with the following description of exemplary embodiments, which are explained in more detail in conjunction with the drawings, in which:

DESCRIPTION OF EMBODIMENTS

Parts which correspond to one another are provided with the same reference signs in all of the figures.

Figure 1:
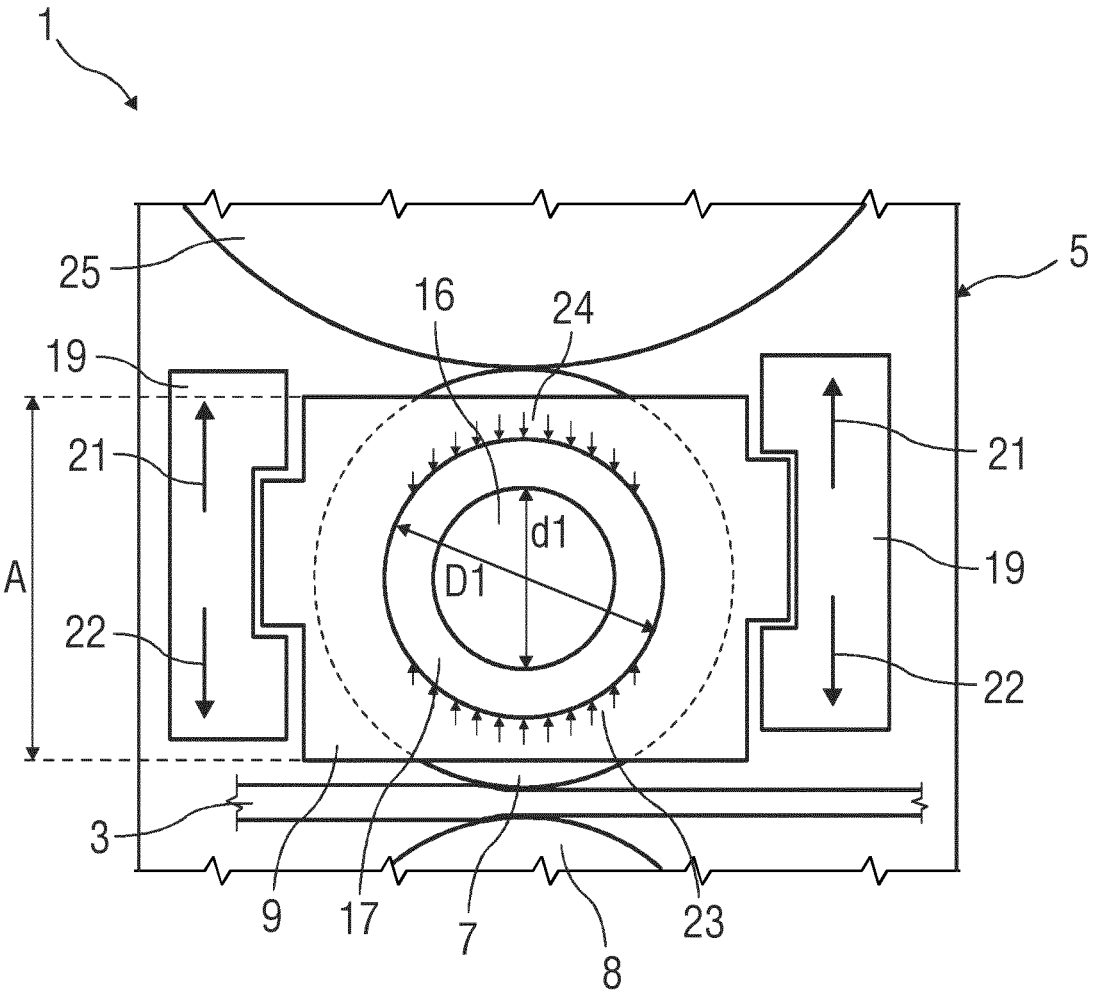
FIG. 1 shows a sectional illustration of an exemplary embodiment of a rolling device in the region of a working roller.

FIG. 1 shows a sectional illustration of an exemplary embodiment of a rolling device 1 according to the invention for the cold rolling of rolled stock 3. The rolling device 1 comprises a rolling stand 5, a plurality of equipment sets for the purpose of selectively equipping the rolling stand 5 with one of the equipment sets, and a working roller drive. Each assembly set comprises two working rollers 7, 8 and, for each working roller 7, 8, comprises two working roller chocks 9 assigned to the working roller 7, 8 and a spindle head 11 assigned to the working roller 7, 8. The two working rollers 7, 8 of one equipment set have the same working roller diameter range. The working rollers 7, 8 of different equipment sets have respective working roller diameter ranges that differ from one another.

Figure 2:
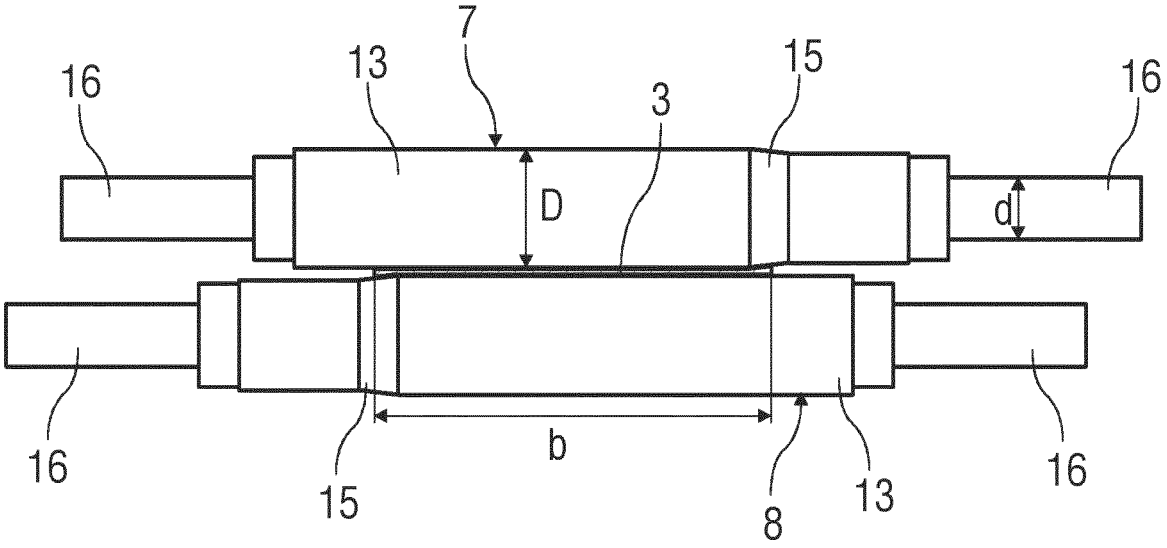
FIG. 2 shows working rollers and a rolled stock guided through between the working rollers.

FIG. 2 shows the working rollers 7, 8 of one equipment set and a rolled stock 3 that is guided through and between the working rollers 7, 8 and has a width b. The working roller diameter D of a working roller 7, 8 is a maximum diameter of the working roller 7, 8 and the diameter D is adopted by the working roller 7, 8 in a center region 13, which is approximately circular-cylindrical and is generally ground to a crown or in the shape of a bottle. One end of the center region 13 of each working roller 7, 8 has a chamfer 15. The chamfers 15 of the two working rollers 7, 8 are arranged spaced apart and opposite one another at each respective end region. Each end region of a working roller 7, 8 is in the form of a working roller journal 16. Each journal has a diameter d which is smaller than the working roller diameter D. The journal diameters d of the working rollers 7, 8 of each of all of the equipment sets match.

In FIG. 2, the working rollers 7, 8 are axially displaced relative to one another in such a way that the chamfers 15 of the two working rollers 7, 8 are each arranged in the region of one of the two lateral strip edges of the rolled stock 3. This relieves the strip edges of the rolled stock 3 of load during the rolling, for example to avoid cracks in the strip edges. The cracks can arise when the strip edges are not relieved of load in the event of rolling rolled stock 3 that is at risk of edge cracks, for example electrical steel strip with a silicon content of at least two percent. In addition, such a mutual axial displacement of the working rollers 7, 8 makes it possible to prevent the center regions 13 of the working rollers 7, 8 from touching each other outside the rolled stock 3 when very thin rolled stock 3 is being rolled.

Figure 4:
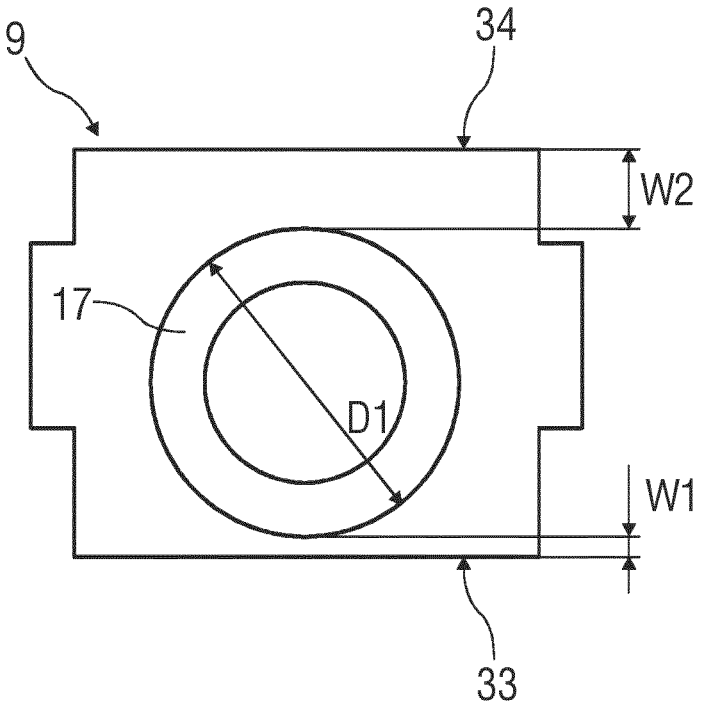
FIG. 4 shows a working roller chock of a further exemplary embodiment of a rolling device, FIG. 5 schematically shows a rolling train with four rolling devices.

In FIG. 4, each working roller chock 9 has a working-roller bearing 17 for a working roller journal 16 of a working roller 7, 8. The working-roller bearing 17 is a roller bearing, for example a tapered roller bearing, having an internal diameter d1, which corresponds to the journal diameter d of the working roller journal 16, and has an external diameter D1. The internal diameters d1 of the working-roller bearings 17 of all equipment sets are at least approximately identical. For example, they deviate from one another by at most two percent. By contrast, the external diameters D1 of the working-roller bearings 17 of the different equipment sets may differ significantly from one another. For example, a diameter ratio D1/d1 of the external diameter D1 to the internal diameter d1 of a working-roller bearing 17 decreases as the roller diameter D of the working rollers 7, 8 of the equipment sets decreases. For example, this diameter ratio is at most 1.32 for at least one equipment set, in particular for equipment sets having small working-roller diameters D. Furthermore, a ratio A/D1 of a height A of a working roller chock 9 to the external diameter D1 of the working-roller bearing 17 of the working roller chock 9 is preferably less than 1.09 for at least one equipment set, in particular for all equipment sets.

In order to roll a rolled stock 3 using the rolling device 1, the rolling stand 5 is equipped with the working roller chocks 9 and working rollers 7, 8 of one equipment set. For this purpose, the rolling stand 5 has four mounts 19, which respectively receive a working roller chock 9 and in which the working roller chocks 9 can be vertically displaced, for example by hydraulic cylinders (not illustrated). In particular, bending forces can be exerted on the working rollers 7, 8 via the mounts 19. A working roller 7, 8 can be positively bent by a bending force in a first bending force direction 21, which is directed away from the rolled stock 3. In the process, in particular, a first load zone 23, facing toward the rolled stock 3, of the working roller chock 9 is subjected to load, with forces that act in the process being illustrated in FIG. 1 by arrows in the first load zone 23. A working roller 7, 8 can be negatively bent by a bending force in a second bending force direction 22, which is directed toward the rolled stock 3. In the process, in particular, a second load zone 24, facing away from the rolled stock 3, of the working roller chock 9 is subjected to load, with forces that act in the process being illustrated in FIG. 1 by arrows in the second load zone 24.

The rolling device 1 of the exemplary embodiment shown in FIG. 1 furthermore has back-up rollers 25, which are arranged above and below the mounts 19 and can be vertically displaced, with the result that their positions can be adapted to the working roller diameters D and positions of the working rollers 7, 8.

Figure 3:
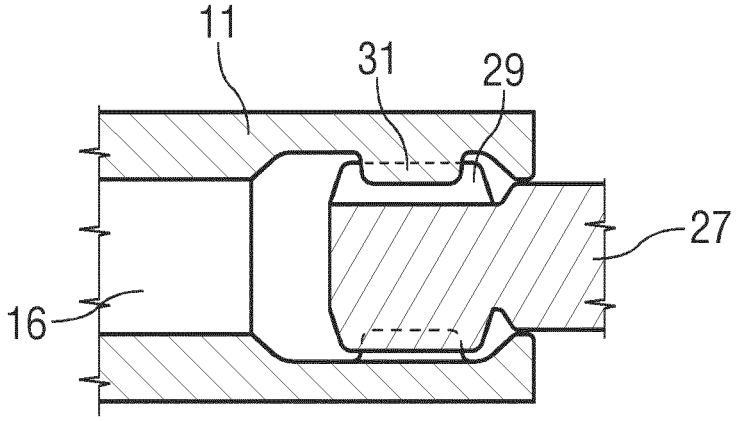
FIG. 3 shows a sectional illustration of a working roller journal, a spindle head and a drive spindle.

FIG. 3 shows a sectional illustration of the working roller journal 16 of a working roller 7, 8, the spindle head 11 assigned to the working roller 7, 8, and a drive spindle 27 of the working roller drive of the rolling device 1. The spindle head 11 has a tubular form. An end, facing toward the working roller journal 16, of the spindle head 11 forms an opening, the cross section of which corresponds to a cross section of the end of the working roller journal 16 and into which the end of the working roller journal 16 projects. The cross section of the end of the working roller journal 16 is not circular, but has, for example, the shape of a circle out of which have been cut two segments of a circle that arise by a point reflection or inversion at the midpoint of the circle. As a result, the spindle head 11 and the end of the working roller journal 16 are connected to one another in a form-fitting manner.

One end of the drive spindle 27 projects into the other end of the spindle head 11. This end of the drive spindle 27 has an external toothing 29, which corresponds to an internal toothing 31 on an inner surface of the spindle head 11, and therefore rotations of the drive spindle 27 about its longitudinal axis are transferred to the spindle head 11 and via the spindle head 11 to the working roller journal 16, and drive the working roller 7, 8. The rotations of the drive spindle 27 are generated by a drive unit (not illustrated) of the working roller drive, for example by a motor.

A wall thickness, an external diameter and the internal toothing 31 of the spindle head 11 are designed for the maximum torque of the working roller drive for driving the working roller 7, 8 to which the spindle head 11 is assigned.

The spindle head 11 is furthermore configured in such a way that an angle between the longitudinal axes of the drive spindle 27 and of the spindle head 11 can be adjusted in order to compensate for a change in position of the working roller 7, 8, for example after the working roller 7, 8 has been ground down.

FIG. 4 shows a working roller chock 9 of a further exemplary embodiment of a rolling device 1. On a side 33 facing toward the rolled stock 3, the working roller chock 9 has a minimum wall thickness W1 which is smaller than a minimum wall thickness W2 on the side 34 facing away from the rolled stock 3. For example, the minimum wall thickness W1 on the side 33 facing toward the rolled stock 3 is less than six percent of the external diameter D1 of the working-roller bearing 17 of the working roller chock 9. When using a working roller chock 9 of this type, a bending limit for positive bending of the working rollers 7, 8 is preferably set as a function of the minimum wall thickness W1 of the working roller chocks 9 on the sides facing toward the rolled stock 3, and the working rollers 7, 8 are not positively bent above the bending limit.

Figure 5:
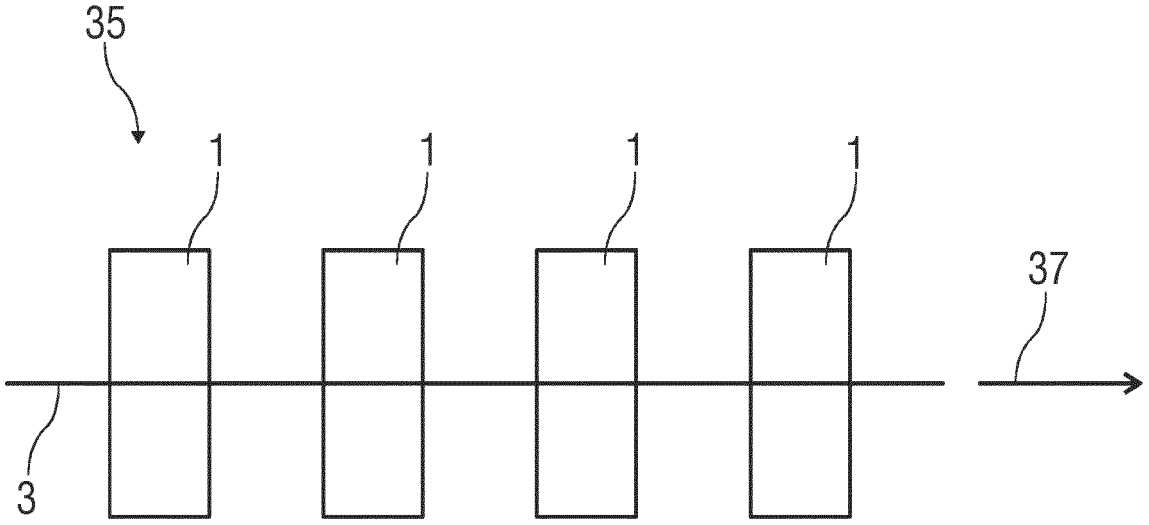

FIG. 5 schematically shows a rolling train 35 with four rolling devices 1 according to the invention. The rolling devices 1 are arranged one behind the other along a rolling direction 37, in which the rolled stock 3 passes through the rolling train 35. All of the rolling devices 1 of the rolling train 35 are preferably of similar design in terms of the drive spindles 27, spindle heads 11, working roller journals 16 of the working rollers 7, 8, and working roller chocks 9, and therefore these components can be exchanged between the rolling devices 1. This advantageously simplifies the provision of spare parts and increases the profitability of the rolling train 35.

According to the invention, the rolling stand 5 of a rolling device 1 is equipped with an equipment set that is selected depending on the rolled stock 3, in particular on its strength, width b, run-in thickness and/or run-out thickness, and on a position of the rolling device 1 in the rolling train 35. For example, in the case of a four-stand rolling train 35, shown in FIG. 5, for producing thin, high-strength and ultra-high-strength rolled stock 3, for example electrical steel strip with a silicon content, the rolling stands 5 of the two rear rolling devices 1 are equipped with working rollers 7, 8 which have working roller diameters D that are smaller than the working roller diameters D of the working rollers 7, 8 with which the rolling stands 5 of the two front rolling devices 1 are equipped. For example, the two rear rolling devices 1 are equipped with working rollers 7, 8 having working roller diameters D of at most 350 mm to 430 mm (depending on the width b of the rolled stock 3) and the two front rolling devices 1 are equipped with working rollers 7, 8 having working roller diameters D of at most 400 mm to 490 mm (depending on the width b of the rolled stock 3).

LIST OF REFERENCE SIGNS

1 Rolling device
3 Rolled stock
5 Rolling stand
7, 8 Working roller
9 Working roller chock
11 Spindle head
13 Center region
15 Chamfer
16 Working roller journal
17 Bearing
19 Mount
21, 22 Bending force direction
23, 24 Load zone
25 Back-up roller
27 Drive spindle
29 External toothing
31 Internal toothing
33, 34 Side
35 Rolling train
37 Rolling direction
A Height
b Width
D Working roller diameter
d Journal diameter
D1 External diameter
d1 Internal diameter
W1, W2 Minimum wall thickness

The invention claimed is:

1. A rolling device for cold rolling of rolled stock, the device comprising:

a rolling stand;

a plurality of equipment sets configured for the purpose of selectively equipping the rolling stand with one of the equipment sets; and a working roller drive, wherein each of the plurality of equipment sets has two working rollers and, two working roller chocks assigned to each of the two working rollers;

each of the two working roller chocks has at least one working-roller bearing for the working roller, and has a spindle head, which is assigned to the working roller and is configured to be connected to a working roller journal of the working roller in a form-fitting manner;

the working rollers each have a working roller diameter range, and each of the working roller diameter ranges is determined by a minimum working roller diameter and a maximum working roller diameter of the working roller;

the working rollers of one of the equipment sets have the same working roller diameter range, and the working rollers of another one of the equipment sets have respective working roller diameter ranges that differ from one another;

the rolling stand has mounts for a respective working roller chock of one equipment set; and the working roller drive has two drive spindles each configured to rotate about a longitudinal axis thereof to drive a respective one of the working rollers via the spindle head assigned to the respective one of the working rollers.

2. The rolling device as claimed in claim 1, wherein the minimum working roller diameter of the working rollers of one of the equipment sets differs from the maximum working roller diameter by 40 mm to 90 mm.

3. The rolling device as claimed in claim 1, wherein the working rollers of one of the equipment sets have a minimum working roller diameter of 340 mm and a maximum working roller diameter of 385 mm, and the working rollers of another one of the equipment sets have a minimum working roller diameter of 375 mm and a maximum working roller diameter of 460 mm.

4. The rolling device as claimed in claim 1, wherein the internal diameters (d1) of the working-roller bearings of all the equipment sets deviate from one another by at most two percent.

5. The rolling device as claimed in claim 1, wherein the working roller journals of the working rollers of all the equipment sets have identical journal diameters (d) and journal shapes.

6. The rolling device as claimed in claim 1, wherein each of the working-roller bearings has a diameter ratio of an external diameter (D1) to an internal diameter (d1), and wherein the diameter ratios of the working roller bearings decrease as the working roller diameter range of the equipment sets decreases.

7. The rolling device as claimed in claim 1, wherein a diameter ratio of an external diameter (D1) to an internal diameter (d1) of the working-roller bearings of at least one of the plurality of the equipment sets is at most 1.41, and wherein a diameter ratio of an external diameter (D1) to an internal diameter (d1) of the working-roller bearings of at least one other equipment set is at most 1.32.

8. The rolling device as claimed in claim 1, wherein a ratio of a height (A) of one the working roller chocks to an external diameter (D1) of one of the working roller bearings of at least one of the plurality of equipment sets is less than 1.09.

9. The rolling device as claimed in claim 1, wherein a minimum wall thickness (W1) of one of the working roller chocks of at least one of the plurality of equipment sets on a side that faces toward the rolled stock is less than six percent of an external diameter (D1) of the working roller bearing of the working roller chock.

10. The rolling device as claimed in claim 1, wherein a minimum wall thickness (W1) of one of the working roller chocks of at least one of the plurality of equipment sets on a side facing toward the rolled stock is at most as great as a minimum wall thickness (W2) on a side that faces away from the rolled stock.

11. A method for the cold rolling of the rolled stock by a rolling device as claimed in claim 1, the method comprising the steps of selecting one of the plurality of equipment sets of the rolling device depending on material properties of the rolled stock, equipping the rolling stand of the rolling device with the one of the plurality of the equipment sets, and guiding the rolled stock between the two working rollers of the one of the plurality of equipment sets whereby the working rollers are rotated about their respective longitudinal axes by the working roller drive.

12. The method as claimed in claim 11, further comprising selecting the one of the plurality of equipment sets depending on a position of the rolling device in a rolling train.

13. The method as claimed in claim 11, further comprising the steps of setting a bending limit for at least one of the plurality of equipment sets for positive bending of the working rollers as a function of a minimum wall thickness of the working roller chocks on the sides of the working roller chocks that face toward the rolled stock, and bending the working rollers positively not above the bending limit during guiding of the rolled stock between the two working rollers.

14. The method as claimed in claim 11, further comprising the step of negatively bending the working rollers of at least one of the plurality of equipment sets depending on a crown of the working rollers during guiding the rolled stock between the two working rollers.

15. The method as claimed in 11, further comprising the step of setting an axial displacement of the working rollers relative to one another for at least one of the plurality of the equipment sets as a function of a width and thickness of the rolled stock during guiding of the rolled stock between the two working rollers.

16. A rolling train having at least one rolling device as claimed in claim 1.

* * * * *